United States Patent [19]

Ikeda et al.

[11] Patent Number: 4,840,030

[45] Date of Patent: Jun. 20, 1989

[54] TAIL PIPE STRUCTURE OF CONTROL TYPE MUFFLER

[75] Inventors: Tsunemi Ikeda; Motoki Ota, both of Tokyo, Japan

[73] Assignee: Calsonic Corporation, Tokyo, Japan

[21] Appl. No.: 146,422

[22] Filed: Jan. 21, 1988

[30] Foreign Application Priority Data

Jan. 28, 1987 [JP] Japan ..... 62-10975[U]

[51] Int. Cl.[4] ..... F01N 7/00

[52] U.S. Cl. ..... 60/324; 181/228; 181/236; 181/237; 181/239; 181/254; 181/268; 181/278

[58] Field of Search ..... 181/228, 254, 268, 278, 181/236, 237, 239; 60/324

[56] References Cited

U.S. PATENT DOCUMENTS 2,083,516 6/1937 Horton ..... 181/278
3,620,330 11/1971 Hall ..... 181/278
4,320,815 3/1982 Norris ..... 181/278
4,665,692 5/1987 Inaba ..... 181/254

*Primary Examiner*—Douglas Hart
*Attorney, Agent, or Firm*—Kalish & Gilster

[57] ABSTRACT

A tail pipe structure of a control type muffler having a first outlet pipe and a second outlet pipe provided with a control valve inserted therein, wherein the first outlet pipe is in communication with the downstream side of the control valve of the second outlet pipe. The mechanism of the muffler is such that when the control valve is opened, the exhaust gases flow into the atmosphere from the first and second outlet pipes. Further, even when the control valve is closed, the exhaust gases in the first outlet pipe flow into the atmosphere therethrough while a part of the exhaust gases flow into the second outlet pipe from the first outlet pipe through the communication pipe and is then discharged into the atmosphere.

5 Claims, 1 Drawing Sheet

TAIL PIPE STRUCTURE OF CONTROL TYPE MUFFLER

BACKGROUND AND SUMMARY OF THE INVENTION

The present invention relates to a tail pipe structure of a control type muffler.

As an example of a control type muffler having a control valve opening and closing in proportion to the number of revolutions of the internal combustion engine, there has been known one that is disclosed in Japanese Laid-open Utility Model Publication No. 61-126022.

FIG. 3 shows this kind of control type muffler. Its structure is such that expansion chambers 17, 19 and 21 and a resonance chamber 23 are defined by partition plates 11, 13 and 15. Further, an outlet pipe 27 having a control valve 25 opens in the expansion chamber 19 and a bent outlet pipe 29 opens into the expansion chamber 21. In the figure, reference numeral 31 designates an inlet pipe, reference numeral 33 designates a resonator pipe and reference numerals 35 and 37 designate inner pipes, respectively.

In the case of the control type muffler of the above-described structure, when the number of revolutions of the engine is less than the set value (low speed), the control valve 25 is closed by a control device 39 and generally low frequency noises reduce at a high exhaust pressure. When the engine speed is higher than the set value (high speed), the valve 25 is opened by the control device 39 and generally high frequency vibrations reduce at a low exhaust pressure.

However, such conventional control type muffler has had problems that due to the fact that the control valve 25 is closed by the control device 39 when the number of engine revolutions is less than the set value, the exhaust gases are discharged into the atmosphere only through the outlet pipe 29 instead of the outlet pipe 27, those who have no knowledge of the mechanism are liable to conclude by mistake that the exhaust system is out of order Further, there has been another problem that in a cold district, the open end of the outlet pipe 27 is adhered with snow or becomes frozen so that it is not possible to thaw the snow or ice until the control valve 25 opens.

The present invention has been made to solve the above problems and it is an object of the invention to provide a tail pipe structure of a control type muffler which allows exhaust gases to be discharged from the outlet pipe having a control valve even when the valve is closed.

In the case of the present invention, the downstream side of the control valve of the second outlet pipe through a communication pipe and therefore, when the control valve is closed, the exhaust gases are discharged into the atmosphere from the first outlet pipe while part of the exhaust gases flow from the first outlet pipe into the second outlet pipe via the communication pipe and is then discharged into the atmosphere.

Accordingly, even when the control valve is closed, it is possible for the exhaust gases to be discharged into the atmosphere through the first and second outlet pipes.

DESCRIPTION OF THE PREFERRED EMBODIMENT

Figure 1:
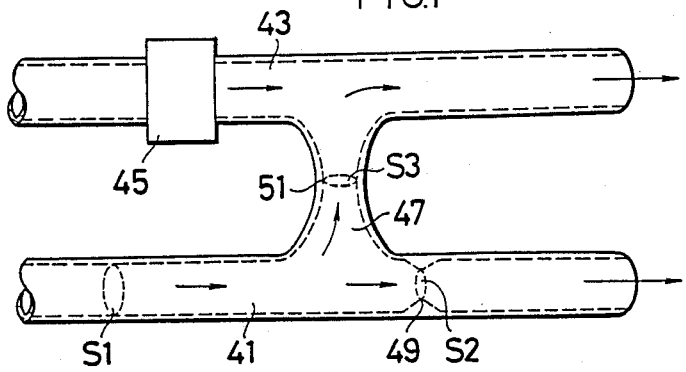
FIG. 1 is a top view of one embodiment of a tail pipe structure of a control type muffler according to the present invention.

The present invention will now be described in detail with reference to the embodiment shown in the drawings.

In FIG. 1 which shows one embodiment of the tail pipe structure of the control type muffler according to the present invention wherein reference numeral 41 designates a first outlet pipe whose one end opens in the muffler (not shown).

Further, reference numeral 43 designates a second outlet pipe whose one end opens in the muffler (not shown) and which has a control valve 45 inserted therein.

In the instant embodiment, the downstream side of the control valve 45 of the second outlet pipe 43 is in communication with the first outlet pipe 41 through a communication pipe 47.

At the downstream side of the first outlet pipe 41 wherein the communication pipe opens, there is formed a first orifice 49 and a second orifice 51 is formed in the communication pipe 47.

In the instant embodiment, assuming that the sectional area of the first outlet pipe be S1, that of the first orifice be S2 and that of the second orifice be S3, the following equation will be established:

$$S2/S1=0.5-0.7.$$

The above value of S2/S1 was obtained by experiments and when there exists the above relationship between the sectional areas S2 and S1 , the amount of exhaust gases discharged into the atmosphere from the first and second outlet pipes 41 and 43 at the time of closing of the control valve 45 looks optimum in appearance.

Further, the relationship between the sectional area S2 and S3 is desirable when the formula of $S3>S2$ is established. It is noted that when the value of S2 is small, air current noises tend to generate resulting in an increase in the noise level and therefore, it is necessary to pay due considerations to the above in selecting the value of the sectional area of S2.

Figure 2:
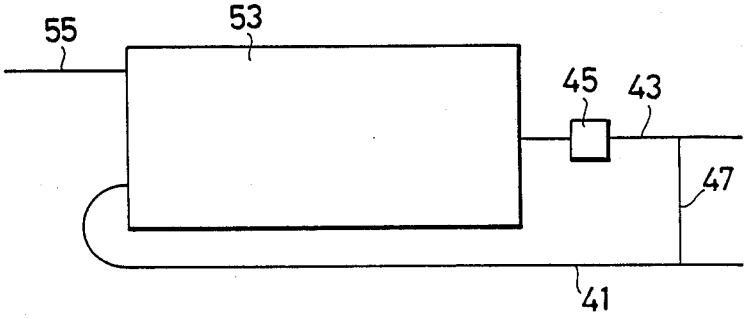
FIG. 2 is a system diagram showing an exhaust system to which the tail pipe structure of FIG. 1 is applied.
Figure 3:
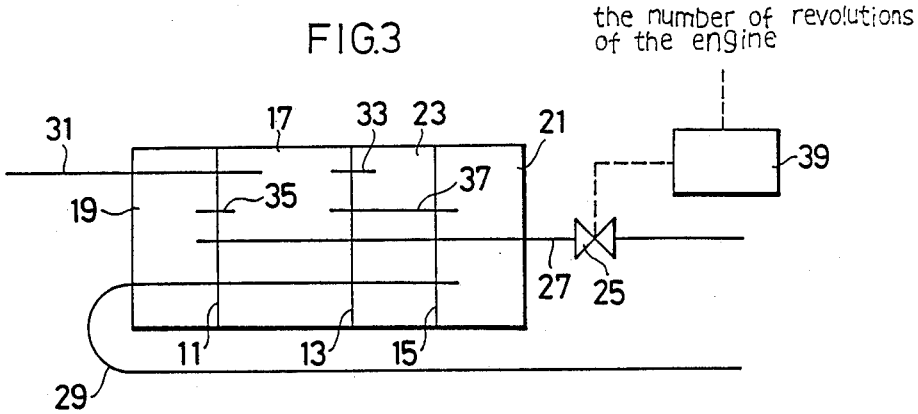
FIG. 3 is an illustrative view of a conventional control type muffler.

FIG. 2 shows an exhaust system to which the above-described tail pipe structure is applied, wherein reference numeral 53 designates a muffler and reference numeral 55 designates an inlet pipe. In this figure, members like those in FIG. 1 are designated by like reference numerals.

According to the above-described tail pipe structure of the control type muffler, the first outlet pipe 41 is in communication with the downstream side of the control valve 45 of the second outlet pipe 41 through the communication pipe 47 so that when the control valve 45 is closed, the exhaust gases are discharged into the atmosphere from the outlet pipe 41 while a part of the gases flow from the first outlet pipe 41 into the second outlet pipe 43 via the communication pipe 47 and is then discharged into the atmosphere.

Further, when the control valve 45 is opened, the exhaust gases in the first outlet pipe 41 flow into the atmosphere therethrough and the exhaust gases in the second outlet pipe 4 flow into the atmosphere therethrough.

Accordingly, it is possible to allow the exhaust gases to be discharged from both the first and second outlet pipes 41 and 43 into the atmosphere at the time of opening and closing of the control valve 45.

As a result, the exhaust gases are in no case discharged into the atmosphere only through the first outlet pipe 41 and therefore, the possibility of misjudging by those who have no knowledge of the mechanism of the muffler that the exhaust system is eliminated.

Furthermore, it is possible to thaw snow or ice adhered to the pipes even when the control valve 45 is closed.

It should be noted that although the above-mentioned embodiment has been described with respect to a case in which the flow rate of the exhaust gases is adjusted by the orifices 49 and 51, the present invention is not always limited thereto and it is of course possible to adjust the flow rate by properly selecting the diameters of the first and second outlet pipes 41 and 43 and the communication pipes.

What is claimed:

1. An internal combustion engine tail pipe structure for use with a control type muffler having first and second outlet pipes each having an upstream side for receiving exhaust gases from the muffler and a downstream side for discharge of engine exhaust gases, the second outlet pipe having a control valve inserted therein, characterized by conduit means downstream of the control valve for establishing communication between said first and second outlet pipes at a point of connection between the upstream and downstream ends of said first outlet pipe.

2. A tail pipe structure for use with a control type muffler having first and second outlet pipes each having an upstream side for receiving exhaust gases from the muffler and a downstream side for discharge of engine exhaust gases, the second outlet pipe having a control valve inserted therein, characterized by conduit means downstream of the control valve for establishing communication between said first and second outlet pipes at a point of connection between the upstream and downstream ends of said first outlet pipe, wherein said first and second outlet pipes comprise an orifice therein downstream of said point of connection.

3. A tail pipe according to claim 2 wherein said conduit means is provided therein with a second orifice.

4. A tail pipe structure according to claim 3 wherein the sectional area of the first-said orifice is of the order of 0.5–0.7 times the sectional area of said first outlet pipe.

5. A tail pipe structure according to one of claims 3 and 4 wherein the sectional area of the first-said orifice is smaller than the sectional area of the second orifice.

* * * * *